US008905443B2

(12) United States Patent
Alber

(10) Patent No.: US 8,905,443 B2
(45) Date of Patent: Dec. 9, 2014

(54) LOCK ASSEMBLY

(75) Inventor: Helmut Alber, Schianders (IT)

(73) Assignee: Hoppe AG, St. Martin i. P. (IT)

( * ) Notice: Subject to any disclaimer, the term of this patent is extended or adjusted under 35 U.S.C. 154(b) by 495 days.

(21) Appl. No.: 12/382,832

(22) Filed: Mar. 25, 2009

(65) Prior Publication Data

US 2009/0267361 A1 Oct. 29, 2009

(30) Foreign Application Priority Data

Mar. 26, 2008 (DE) ..... 20 2008 004 173 U

(51) Int. Cl.

| | |
|---|---|
| ***E05C 3/06*** | (2006.01) |
| ***E05C 19/00*** | (2006.01) |
| ***E05B 15/02*** | (2006.01) |
| ***E05B 63/20*** | (2006.01) |
| ***E05B 65/08*** | (2006.01) |

(52) U.S. Cl.

CPC ..... *E05C 19/008* (2013.01); *E05B 15/022* (2013.01); *E05B 63/20* (2013.01); *E05B 65/08* (2013.01); *E05B 2015/027* (2013.01)

USPC ..... 292/216; 292/341.15; 292/341.17

(58) Field of Classification Search

USPC ..... 292/216, 340, 341.15 X, 341.17 X

See application file for complete search history.

(56) References Cited

U.S. PATENT DOCUMENTS

| | | | | |
|---|---|---|---|---|
| 2,709,101 A | | 5/1955 | Dickinson | |
| 3,244,444 A | | 4/1966 | Bisbing | |
| 3,520,568 A | * | 7/1970 | White et al. | 292/255 |
| 3,553,984 A | | 1/1971 | Grumbach | |
| 5,098,141 A | | 3/1992 | Bull | |
| 5,906,404 A | * | 5/1999 | McGhee | 292/340 |
| 5,997,056 A | * | 12/1999 | Yamagishi | 292/341.17 |
| 2002/0074811 A1 | | 6/2002 | Kuenzel | |

FOREIGN PATENT DOCUMENTS

| | | |
|---|---|---|
| DE | 1 142 527 | 1/1963 |
| DE | 100 58 945 | 5/2002 |
| DE | 101 25 915 | 12/2002 |
| DE | 10 2004 023 608 | 12/2004 |
| DE | 10 2006 007 691 | 6/2007 |

* cited by examiner

*Primary Examiner* — Mark Williams

(74) *Attorney, Agent, or Firm* — Reinhart Boerner Van Deuren s.c.

(57) ABSTRACT

The invention relates to a lock assembly (10) of a planar component (22) displaceably mounted in frame (30). Said assembly (10) comprises an engaging element (40) which, in said planar component's closed position, can be fixed in place in a latching system (50). Said latching system is designed in a manner that, in its blocked position, the engaging element, for instance a bar affixable by compression and/or friction in the latching system (50), can be inserted into latter in a first direction (R) opposite the direction of closing (X) of the planar component (20), whereas such insertion is blocked in a second direction (S) which is opposite said planar component's direction of opening (O). This design allows almost noiselessly operating the lock assembly. The planar component also may be closed when the latching system is in the blocked position already when the planar component is open. Moreover all double fittings are averted and as a result the said planar component always can be closed and be locked in play-free manner.

23 Claims, 7 Drawing Sheets

LOCK ASSEMBLY

Figure 1:
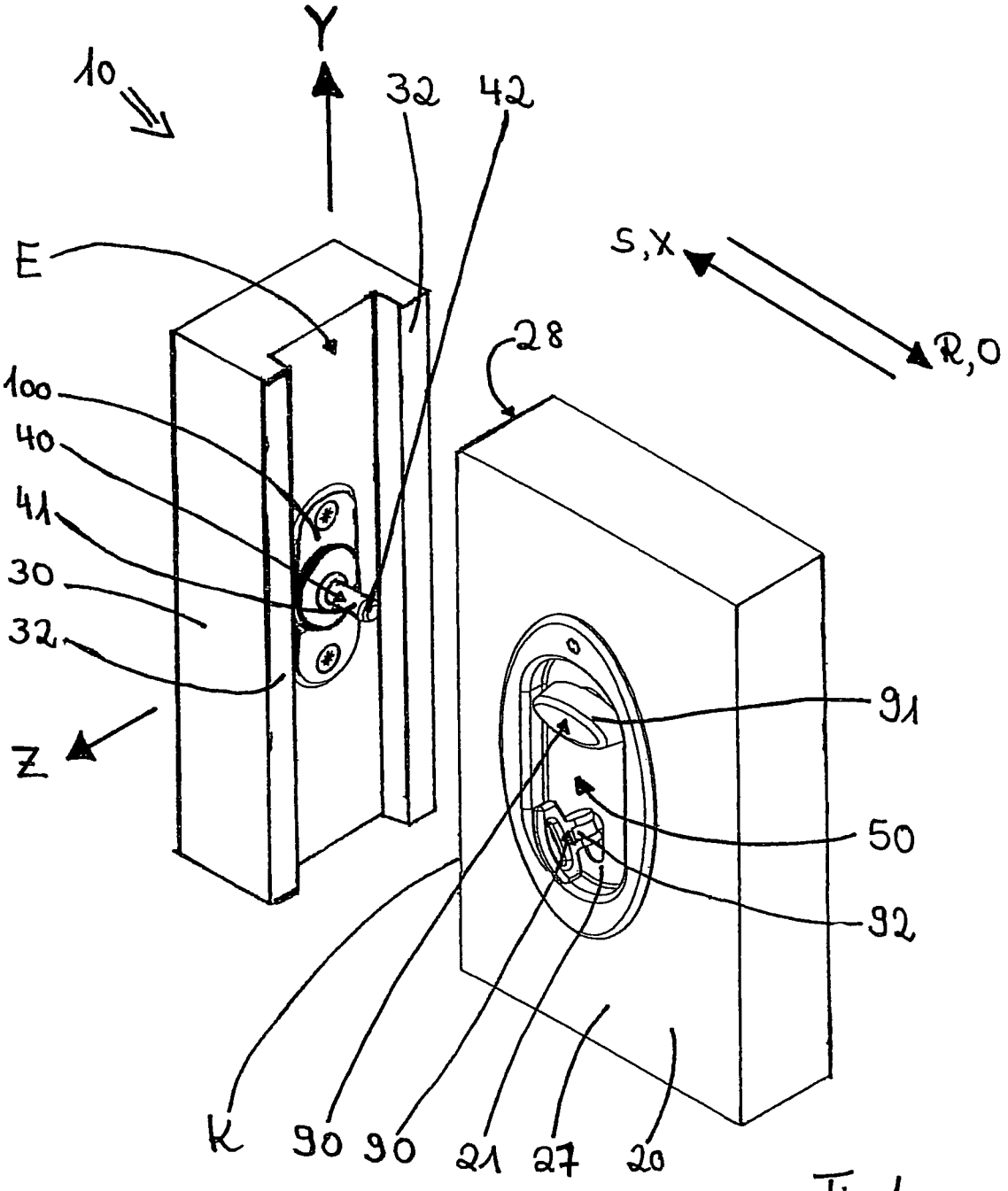

The present invention relates to a lock assembly foremost for a planar component, in particular a door or a window, as defined in the preamble of claim 1.

Lock assemblies for locking doors and windows, in particular for sliding doors, are mostly composed of two sub-assemblies. A first sub-assembly is integrated as a latching system (the lock proper) into the end face of a planar component, for instance a door wing, whereas a second sub-assembly act as an engaging element or strike plate at or in a frame. When closing the door wing, one or more pivotable bolts and/or (hook) latches constituted in the lock act on the engaging element or the strike plate, whereby the door first is locked and kept in this configuration. An operating element such as a handle or a knob which disengages the usually spring-loaded latch out of the engaging element or strike plate, the door then being released.

Locking the door requires rigidly affixing the latch, by means of an additional latching element, into the engaged position. Typically an additional operating element is provided in/at the lock, for instance a key or a safety catch driving a blocking element stopping the latch.

The German patent document DE 100 58 945 A1 illustratively discloses a sliding wing lock comprising two bolts being linked to each other by a substantially linearly displaceable coupling element which drives them jointly between a locked and an unlocked position. In the locked configuration, the bolts enter a striker plate in the door frame. In this process they are prestressed by a restoring spring. Locking is implemented by a separate blocking element when it is in its blocked position precludes bolt displacement.

This design incurs the drawback the door cannot be closed as long as the latching system is engaged, for instance by accident. An attempt to close when the bolt is already in its stopped position may well damage the latching system or the door, respectively the frame. Again said door/window cannot be closed when the bolt is in its open position.

Accordingly locks secured against erroneous operation already have been made that preclude accidentally blocking the bolt respectively the latch when the door is open (see for instance the German patent document DE 101 25 915 A1). However such solutions are complex and therefore uneconomical in their manufacture. Moreover closing the locks of this design also incurs the drawbacks of other solutions, namely they are fairly noisy when operated.

Another drawback of known sliding-wing door locks is the required dual fitting. The sliding door should rest uniformly against the full frame height and at the same time the latch shall engage in play-free manner the striker plate or the engaging element. Due to installation inaccuracies or the door's thermal warping, such close fit is not assured, and the door may not close properly or the latch may not reliably engage the engaging element at the door frame.

The German patent document DE 10 2004 023 608 A1 discloses a lock fitted with a housing receiving a reciprocable spring-loaded bolt. Said bolt affixes a pivotably supported, hook-shaped drop-bolt into in its open position. Only after the bolt has been actuated can the drop-bolt engage an O-shaped or U-shaped engaging element affixed to the door frame. The purpose of the engaging element is to allow always reliably closing even warped doors (for instance aboard ships) because the drop-bolt always can reliably enter the O- or U-shaped engaging element. However the double-fit problem remains unsolved in this disclosure too. Moreover there is danger the door might be closed when the bolt is locked, though this is impossible.

The German patent document DE 10 2006 007 691 83 discloses a compact locking unit fitted with a closing bolt engaging the lock. Said closing bolt is fitted at its end face with a circumferential groove which can be engaged by a closing bolt that can be stopped in a control block. This design precludes locking a door still open after it was previously accidentally latched already. Moreover this mechanism entails very complex manufacture and also depends on the double fit between the door wing and the door frame. Accordingly undesired and bothersome noise is generated when closing the door.

The objective of the present invention is to eliminate the above and further drawbacks of the state of the art and to create an easily handled lock assembly for doors and windows which can be manufactured using simple means. In particular the present invention offers a solution to close a planar component even when said assembly's latching system already was shut while said component was still open. The present invention moreover allows engaging nearly noiselessly engaging the lock assembly without resort to special or additional procedures. Any dual fitting is eliminated, as a result of which said planar component always can be locked fully and absent any play.

The main features of the present are defined in claim 1. Embodiments of the present invention are defined in claims 2 through 37.

The present invention relates to a planar component's lock assembly, in particular for a door or window, said component being displaceably held in a frame, the assembly comprising an engaging element which can be affixed in a latching system when said planar component is in the closed position, where the invention uses an engaging element in the form of a bar, a spindle or the like that can be compressionally or frictionally affixed in the latching system which is designed in a manner that, in its blocked position, the engaging element may be inserted into it in a first direction opposite the planar component's direction of closing and in that it shall be blocked in a second direction which is opposite the planar component's direction of opening.

In especially advantageous manner, the engaging element may be inserted along the first direction even when the latching system shall be in its blocked position. As a result, damages to the locking mechanism, to the planar component and to the frame may be averted when accidentally the latching system was moved into the blocked position while the door was open. In this manner the door or the window may therefore be closed in any locked state.

Again, in highly advantageous manner, when the engaging element has acted on the latching system, it cannot be disengaged in a direction opposite to said first direction. This feature allows closing the door or window, and locking it at the same time, in a single motion, when the latching system was intentionally moved at an earlier time, while the door or window was open, into the blocking position.

In one advantageous embodiment of the present invention, the engaging element may be freely inserted along the first direction. Moreover the engaging element may be fixed in place by blocking and/or clamping elements when moving in the opposite direction. The present invention attains such a feature while devoid of any biased bolts, any rear-acting hooked latches or similar detent or snap-in locking elements. This feature provides a further advantage: locking noise is virtually eliminated. Instead, the engaging element—which is free-running in the first direction—may be smoothly and continuously inserted into the lock, namely noiselessly. If an attempt is made to displace the engaging element in the latching system opposite said first direction—for instance by moving the planar component away from the frame—the blocking and/or clamping elements of the present invention immediately hold the engaging element in place, without resorting to releasing a further mechanism. In this respect too noise is virtually precluded.

The blocking and/or clamping elements appropriately cooperate with a side face of the engaging element and may engage said face in compressionally, mechanically interlocking and/or frictional manner. Said blocking and/or clamping elements shall be actuated when the planar component is moved toward its frame and the engaging element enters the latching system. Such actuation may be axial and/or radial. Advantageously too, the blocking and/or clamping elements should be guided in or on an axially displaceable drive element.

In such an embodiment mode of the present invention, when the latching system is in its blocked position, the blocking and/or clamping elements constrict the diameter of an aperture of said latching system, when the said engaging element all open said aperture. Appropriately the unconstricted diameter of said aperture corresponds to that of the engaging element. When the engaging element is actuated, the blocking and/or clamping elements constricting said aperture are constrained into contact with the engaging element. This engaging element may only continue being active along said first direction as long as the blocking and/or clamping elements are able to get out of its way. Illustratively such a feature can be implemented by the axially displaceable drive element. This drive element guides the blocking and/or clamping elements for instance in a manner to force them back when it moves along the first direction. In the process the drive element itself is also displaced along the first direction. Subsequently the clamping and/or blocking elements consecutively release the aperture into which the engaging element is inserted. As a result the engaging element is free to move in the first direction to act on said clamping elements.

In a significant embodiment mode of the present invention, the drive element is biased by a permanent force, preferably a spring force, in the second direction opposite said first direction. Said force causes the drive element to be moved back along the second direction as soon as the spring force exerted in the second direction exceeds the engaging element's force in the first direction. In the process the blocking and/or clamping elements are forced back into the blocked position. As a result, the diameter of the aperture now receiving the engaging element is constricted again. Thereby the blocking and/or clamping elements come to rest in compressive and/or frictional manner against the engaging element's side surface and no longer are able to get out of the way of the engaging element. In this manner said engaging element is kept in place in the latching system for instance by friction between the side surface and/or the blocking elements at these elements. This immobilization of the engaging element in the latching system can be undone in the present invention by displacing the drive element along the first direction.

Further embodiment modes relate to different designs of the blocking and/or clamping elements:

To enable the blocking and/or clamping elements to constrict or release the aperture diameter, the latching system is advantageously fitted with an oblique surface. As a result the blocking and/or clamping elements—illustratively in the form of balls, rollers, wedges or the like—may be configured between said oblique surface and the drive element. In one embodiment mode of the present invention, the drive element is fitted with feedthroughs that receive the blocking and/or clamping elements. When displacing the drive element along the bevel, the blocking and/or clamping elements may then pressed through the feedthroughs into the aperture receiving the engaging element. Consequently the aperture diameter is reduced. When the drive element is moved along the opposite direction, the blocking and/or clamping elements are able to move back and clear the aperture.

In a further embodiment mode of the present invention, the blocking and/or clamping element is a clamping frame or a clamping pane that may be wedged against the said bevel. This particular clamping element also is fitted with an opening enclosing engaging element. Moreover it is oriented obliquely to the said first direction. The diameter of the aperture receiving the engaging element inserted along the said first direction depends on the angle subtended between said clamping element and said first direction. When the engaging element's aperture is nearly orthogonal, its diameter is almost that of the clamping element's opening. Tilting relative to said first direction on the other hand entails reducing the effective diameter of the aperture for the engaging element and hence causes clamping this engaging element. Also, a minimum of two clamping frames or clamping panes may be used.

Appropriately, moreover, the lock assembly shall include a fastener. This fastener may be fitted with an axial borehole again receiving the drive element and the blocking and/or clamping elements. The said oblique surface also may be configured directly in the fastener. These features taken together offer the advantage that the latching system, being a pre-assembled unit, can be inserted in very simple manner into the planar component. For that purpose the fastener—which supports the latching system—may be threaded at its end zone.

The latching system design including an operating element also is advantageous. Many different kinds of operating elements are applicable, depending on need, for instance such as a bathroom knob, a key, a door handle or an arbitrary combination of such. The important feature is that the operating element be linked directly or indirectly with the drive element. In this respect the drive element can be axially displaced by the said operating element. Then actuating the operating element reciprocates the drive element between the blocked position and the release position. A further design provides that the drive element can be fixed by means of the operating element in said lock's blocked and/or release positions.

Advantageously the engaging element may act on the latching system in tight-fit manner. For that purpose a further design of the present invention provides that the engaging element be supported in floating manner and able to orient itself in two directions. Preferably such an adjustment shall be spatially continuous, for instance being in the form of a displacement/shift. For that purpose the lock assembly is fitted with a bracket mounted on the frame or the planar component and supporting the engaging element. When the planar component is being closed at the frame, the floating and continuously self-orienting engaging element will reach the lock's aperture. It matters not whether the engaging element was exactly aligned by means of a dual fit with said aperture during assembly. Should there be a fitting inaccuracy and should the engaging element hit the latching system when offset from said aperture, said floating engaging element shall move away from the pressure due to the closing planar component and in this manner be automatically aligned with the aperture.

Lastly the latching system is fitted with a mechanical stop and the operating element may be configured at or in said stop.

Further features, details and advantages of the present invention are stated in the claims and in the following description of illustrative embodiment modes and in relation to the appended drawings.

Figure 2A:
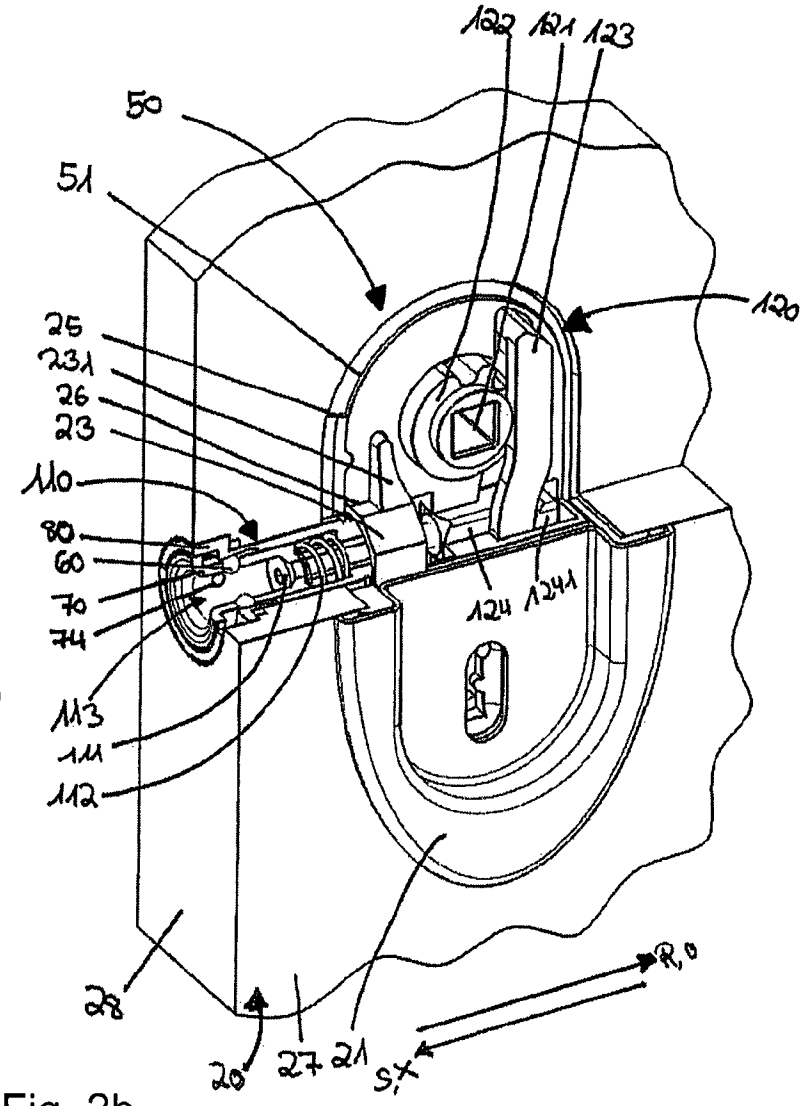
Figure 2B:
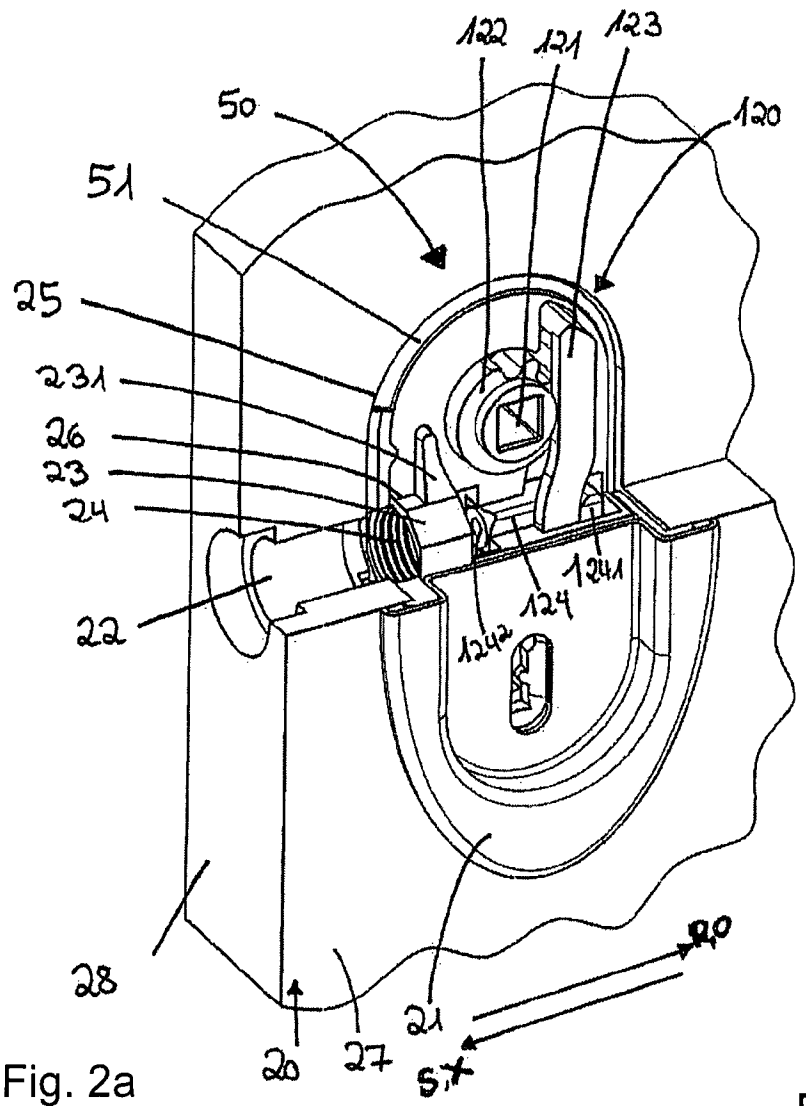
Figure 3A:
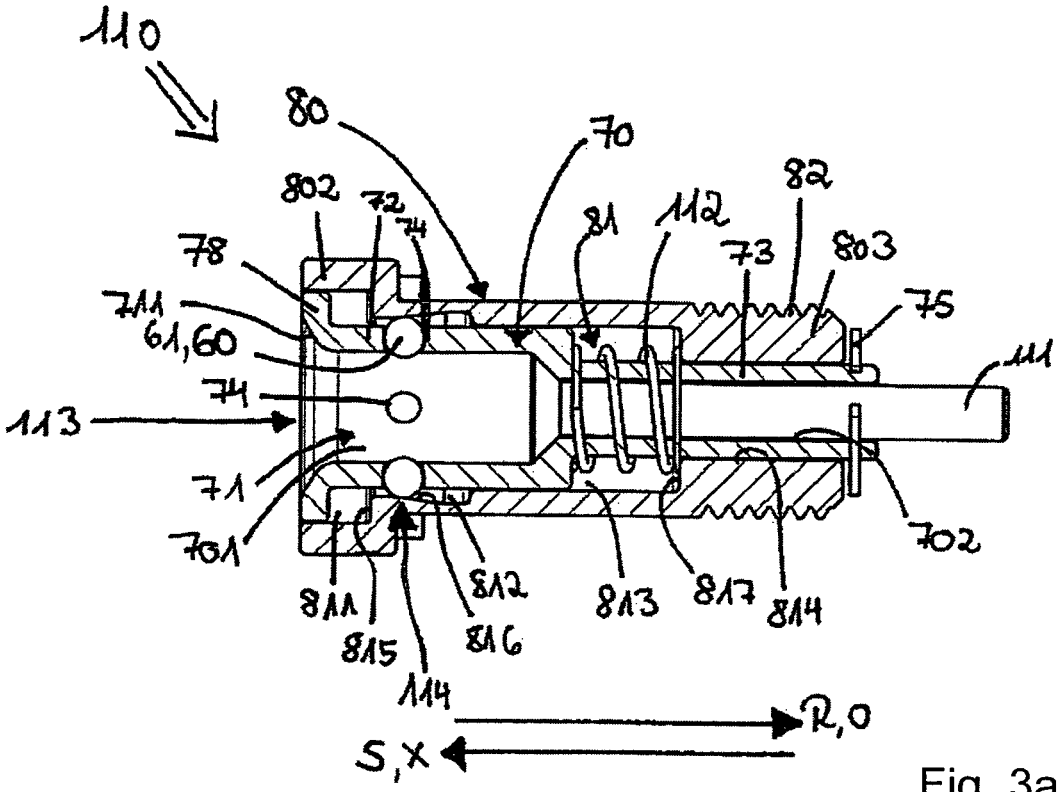
Figure 3B:
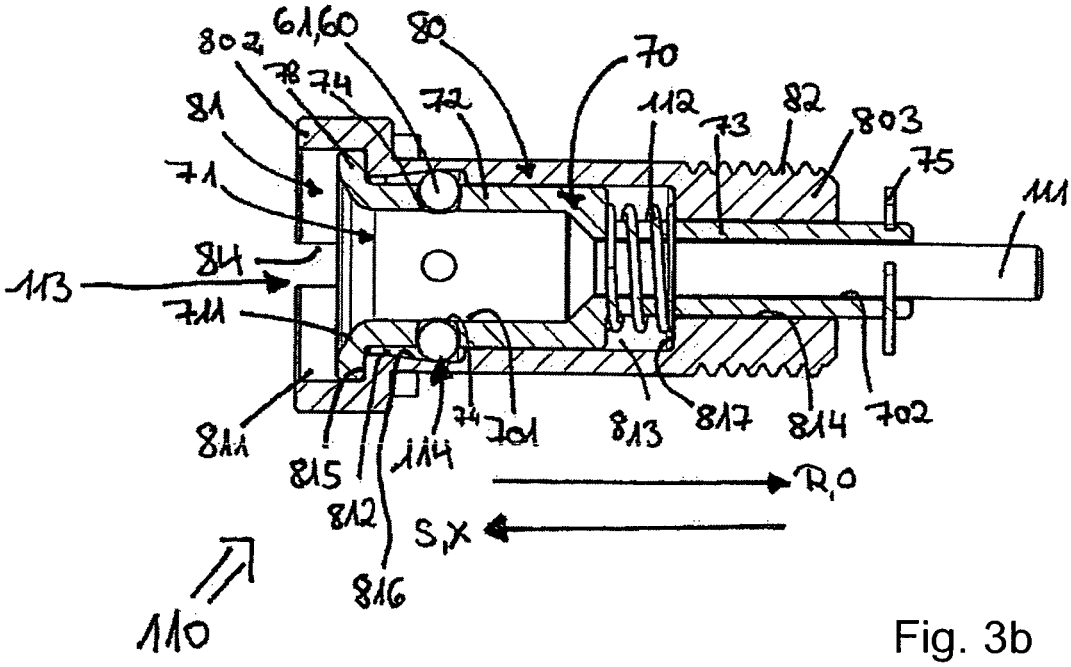

FIG. 1 schematically shows a lock assembly for a planar component such as a door or window, FIG. 2*a* is partial-section, schematic view of a latching system of said lock assembly devoid of a clamping mechanism, FIG. 2*b* schematically shows the latching system of FIG. 2*a* fitted with a clamping mechanism, FIG. 3*a* is a longitudinal section of a clamping mechanism of the latching system of FIG. 2*a* in its blocked state, FIG. 3*b* shows the clamping mechanism of FIG. 3*a* in the opened i.e. unlocked state.

Figure 4A:
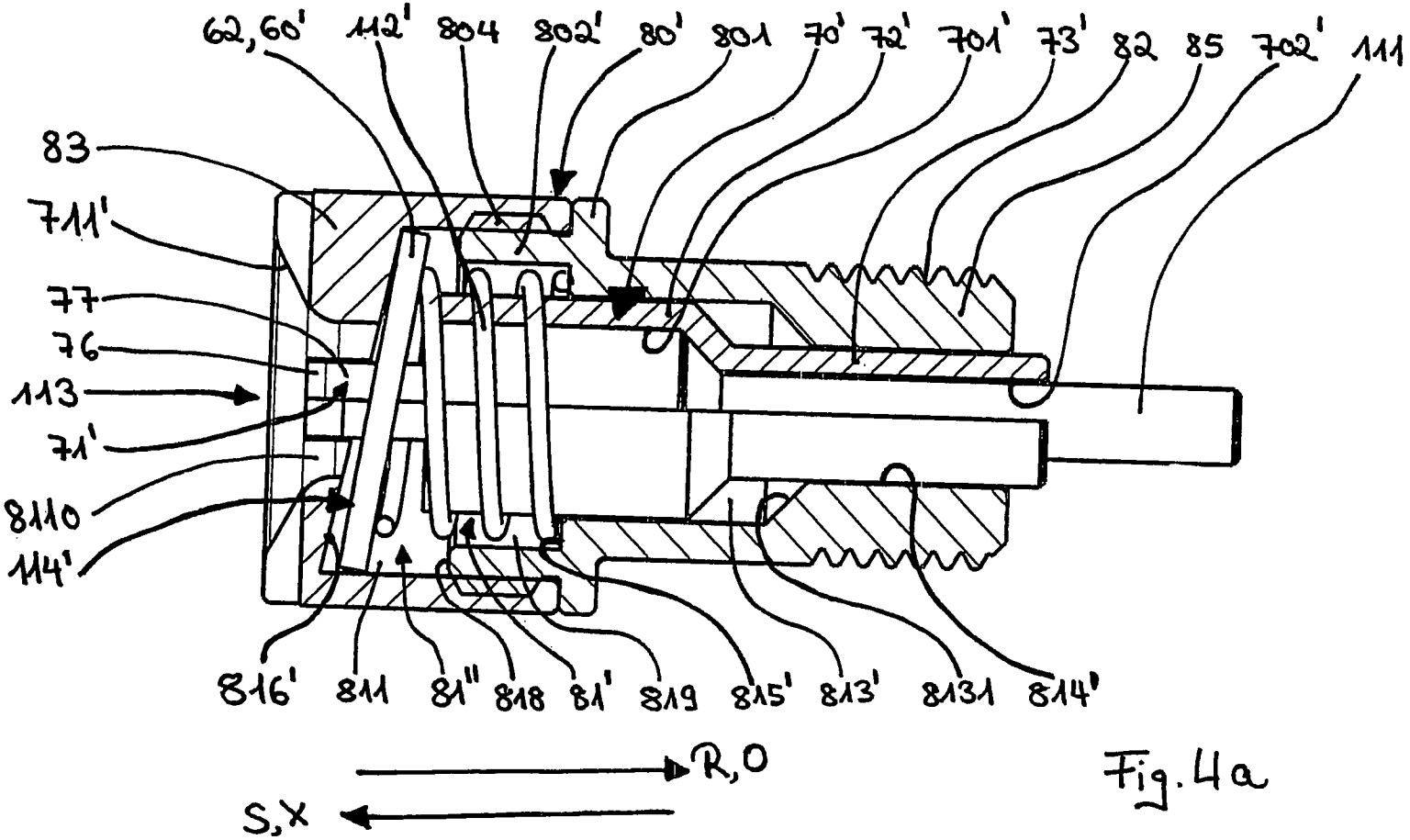
Figure 4B:
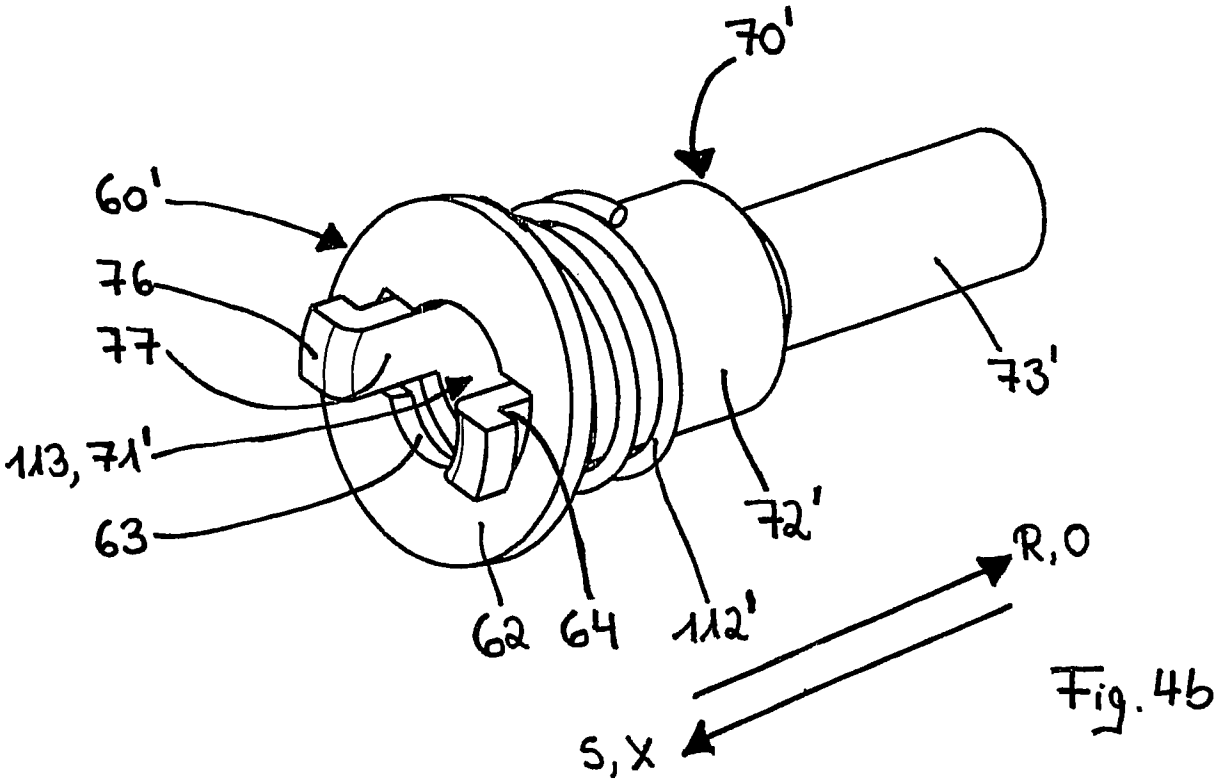
Figure 4C:
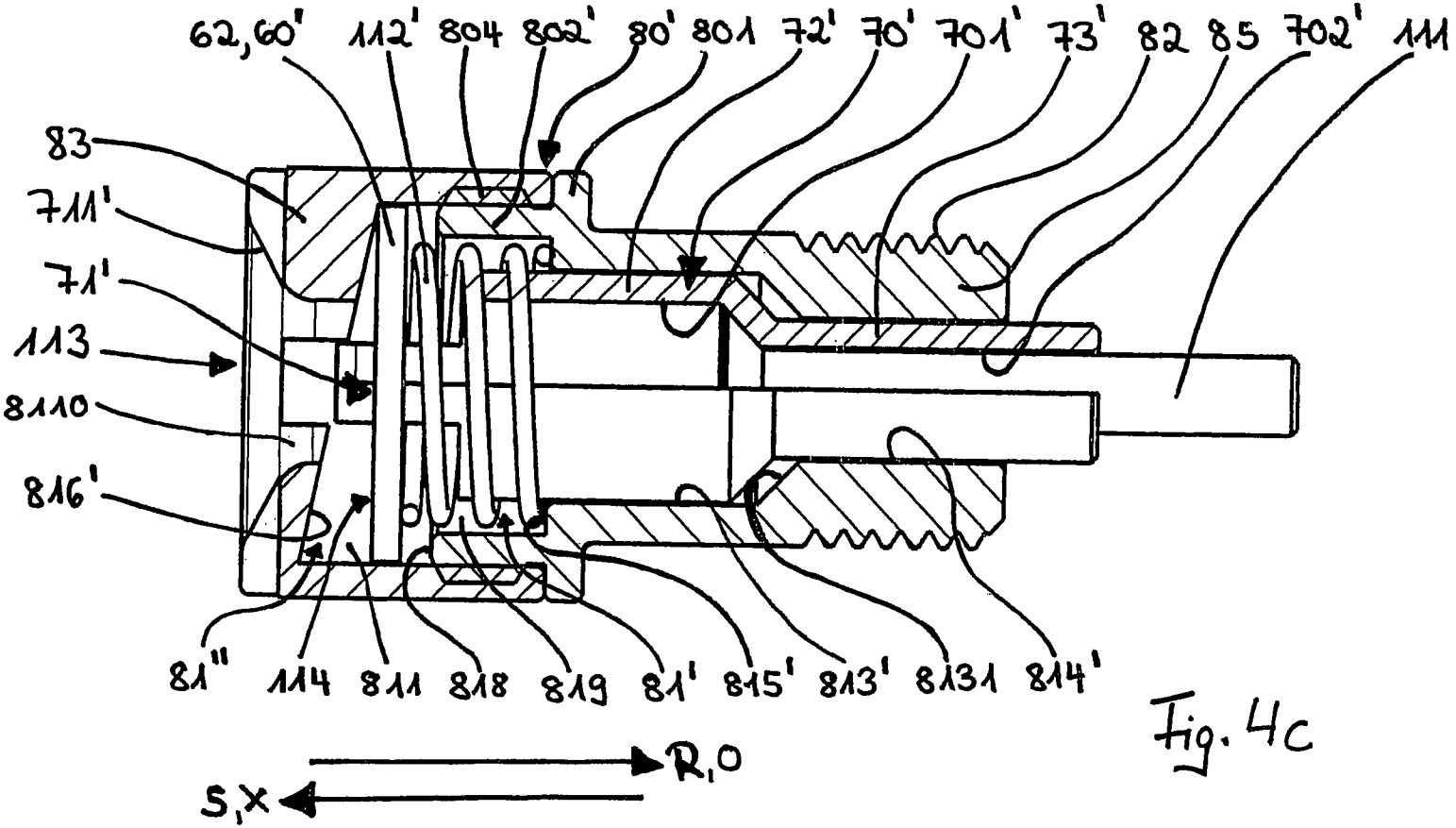
Figure 4D:
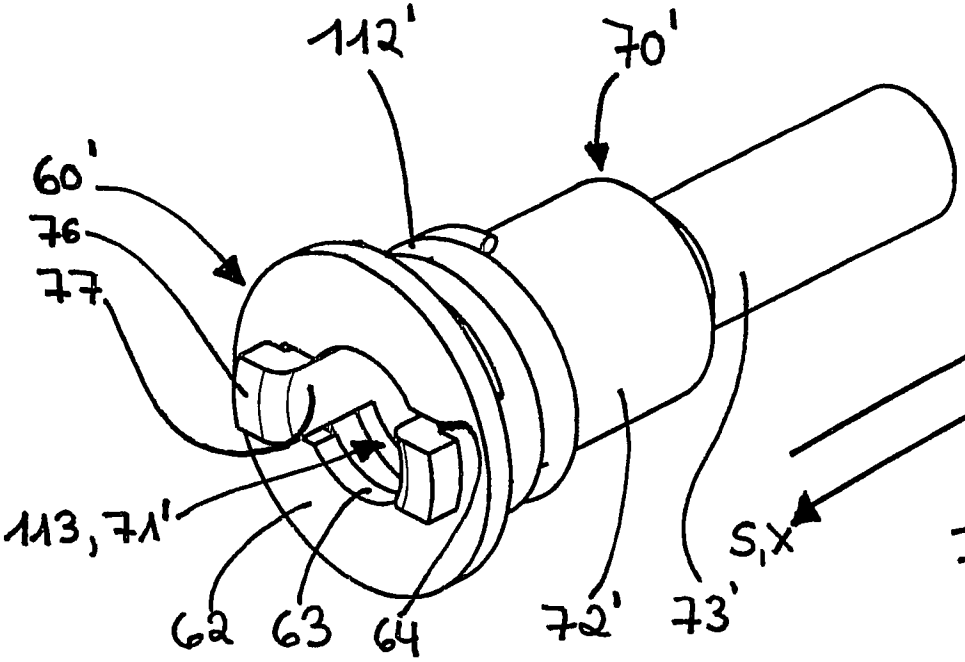

FIG. 4*a* is a longitudinal section of another embodiment mode of a clamping system fitted with a fastener and a latching system in the blocked state, FIG. 4*b* is a schematic oblique view of the clamping system of FIG. 4*a*, FIG. 4*c* is a schematic oblique view of FIG. 4*a* in the opened, i.e., unlocked state, and FIG. 4*d* is a schematic oblique view of the clamping system of FIG. 4*a* in the opened state.

The lock assembly denoted in its entirety by 10 in FIG. 1 is designed for a sliding door. Such a door comprises a planar component 20 in the form of a sliding door wing displaceably supported in a (partly shown) door frame. The sliding door wing 20 is moved along the closing direction X when the door is being closed until coming to rest by its end face 28 against a door frame 30. The door frame 30 is fitted with a recess E the width of which approximately corresponds to the thickness of the sliding door wing 20. In the door's closed position, the longitudinal edges K of the sliding door wing 20 are covered by lateral square shoulders 32 of the frame 30 that at the same assure guidance and centering of the door wing 20. The sliding door wing 20 shall be moved along the direction of opening O when the door is opened.

Within the recess E, the frame 30 comprises an engaging element 40 which, in the door's closed position, engages a latching system 50 (not visible in FIG. 1). This latching system is laterally integrated as a lock into the sliding door wing 20 and is covered on both door sides by trims 21. The trims are in the form of sliding door mussel-shells and countersunk into the door wing 20 in a way that an operating element 90 situated in the recess of the trim 21 may be flush with the side 27 of the door wing 20. The operating element 90 drives the latching system 50, at least one element 90 being configured in each trim 21 on both door sides, for instance a bathroom knob 91, its mating part or a key 92. However, as indicated in FIG. 1, two operating elements 90 also may be used, the key 92 where called for being extractable. The operating element 40 in the recess E of the frame 30 is mounted on a bracket 100 affixed by omitted screws to the door frame.

A recess 25 is laterally fitted into the sliding door wing 20 to receive the latching system 50 and, as shown in FIGS. 2*a*, 2*b*, depending on the shape of the trims 21, it may be oval. Other shapes are conceivable. What matters is solely that the recess 25 shall receive the latching system 50 and be fully covered by the trims 21.

A clamping mechanism 110 embedded in the end face 28 of the door wing 20 is used to lock the door. For that purpose said wing is fitted with a horizontally stepped borehole 22 issuing sideways into the recess 25 (FIG. 2*a*). The borehole 22 and hence the clamping mechanism 110 are configured in a way that the engaging element 40 be able to enter them completely as soon as the sliding door wing 20 in its closed position comes to rest against the frame 30. Accordingly the clamping mechanism 110 is fitted at its end side with an engagement aperture 113 and is designed so that the bar 40 can be affixed in compressive and/or frictional manner in the engagement aperture 113 and thereby in the latching system 50, as a result of which, in the blocked position of the latching system 50, the bar 40 can be inserted in a first direction R opposite to the direction of closing X of the sliding door wing 20 into the latching mechanism 110, whereas said pin insertion is blocked in a second direction S opposite the direction of opening the door wing 20.

FIG. 1 indicates that the engaging element 40 is designed as a cylindrical closing bar floatingly supported on the bracket 100, that is, the bar 40 is able to move both in a direction Y along the frame 30 and in a direction Z perpendicular to the direction Y. This features assures that, when the door is being closed, the bar 40 always can tightly fit and dip into the clamping mechanism 110 even if the door wing 20 and/or the frame 30 be warped for instance due to external, illustratively thermal factors. Also dimensional inaccuracies or wear-entailed offsets between the door and its frame shall always be compensated reliably, permanently, and without resort to tools.

FIGS. 2*a*, 2*b* further show that the latching system 50 is fitted in a housing 51 with a rotatably supported spindle bush 122 receiving an omitted square spindle by means of a square aperture 121. The square spindle is connected irrotationally and in axially fixed manner to at least one of the operating elements 90, for instance the omitted bathroom knob 91 and its omitted mating element.

The housing 51 moreover contains a coupling mechanism 120 which is operationally linked to the spindle bush 122 and to the clamping mechanism 110 inserted into the stepped borehole 22. Said gear rack is connected by a coupling element 124 to the clamping mechanism 110. Illustratively teeth not referenced any further are configured on said spindle bush's external periphery and mesh with a gear rack 123 which is supported in longitudinally displaceable manner. Illustratively the coupling element 124 is fitted at one end with a hook 1241 engaging from behind the slightly bent gear rack 123. The other (front) end of the coupling element 124 is fitted with a threaded borehole 1242. The borehole 1242 receives a fastening screw 111 connecting the clamping mechanism 110 to the coupling element 124.

At its side pointing to the end face 28 of the sliding door wing 20, the housing 51 is fitted with a notch 26 receiving an octagonal nut 23 fitted with an inside thread 24. The octagonal nut 23 is fitted with a beak 231 precluding said nut from rotating relative to the housing 51. The octagonal nut 23 serves to affix the clamping mechanism 110.

The clamping mechanism 110 shown in FIGS. 3*a*, 3*b* is an essential part of the latching system 50 and is designed for pre-assembly. It comprises an outer muff 80 and holds within it a drive element 70 which is supported in axially displaceable manner and which is fitted at its end face with the engaging aperture 113 for the locking bar 40. A clamping system 114 is configured within the muff 80 in the region of the drive element 70 to axially affix the closing bar 40 when the door is in its closed position to allow locking said door when called for.

The muff 80 is fitted with a central stepped borehole 81 comprising a total of three segments 811, 813, 814 to receive said drive element 70. The inside diameter of the first segment 811 is the largest. It is subtended in a flange end 802 of the muff 80 and terminates at a step 815. The inside diameter of the second segment 813 of the borehole 81 is smaller and at least partly conical in order to subtend an oblique surface 816 within the borehole 81. The third segment 814 begins after a step 817 and subtends the smallest inside diameter, terminating at the rear end 803 of the muff 80. Said muff is fitted with an outer thread 82 which, in the installed state of the latching system 50, enters the octagonal nut 23 of the housing 51. To allow threading the muff 80 through the stepped borehole 22 into the octagonal nut 23, at least two notches 84 are subtended edgewise in the flange end 802 to allow access to an installing tool.

The drive element 70 is fitted with a cylindrical engaging part 72 inserted with minute displacement play into the middle segment 813 of the borehole 81 of the muff 80. The front end of the engaging part 72 comprises a radially outward collar 78, a neck segment 73 adjoining the opposite rearward end of said engaging part and also sliding with minute displacement play in the borehole segment 814.

The entire engaging part 72 is crossed by a stepped, axial borehole 71. The front, diametrically larger portion 701 of the borehole 71 constitutes the engaging aperture 113 for the closing bar 40 of which the outside diameter corresponds, except for a slight displacement play, to the inside diameter of the engaging aperture 113 respectively of the borehole 701. The rear portion 702 of the borehole 71 is situated in the neck segment 73 and receives the screw 111 which—when the latching system 50 has been installed—engages the threaded borehole 1242 of the coupling element 124.

As further shown by FIGS. 3*a* 3*b*, the clamping system 114 is constituted by radially and axially guided blocking and/or clamping elements 60 cooperating with the oblique surface 816 of the stepped borehole 81 of the muff 80. In the present embodiment mode, the blocking and/or clamping elements 60 are balls, for instance four or more balls 61 constituting a revolving set of balls. Other roller or blocking elements are applicable, for instance cylindrical rollers or blocking shoes. The engaging part 72 of the drive element 70 is fitted peripherally with radial boreholes 74 receiving and guiding the balls 61, said radial boreholes being designed in a manner that the balls 61 shall be able to enter the engaging aperture 113 but be prevented from passing through it. Illustratively the boreholes 74 may be slightly conical.

A compression spring 112 is configured between the muff 80 and the drive element 70. Said spring encloses the collar portion 73 of the drive element 70 and rests against the step 817 of the borehole 81, as a result of which the drive element 70 together with its engaging part 72 is permanently biased in the direction S respectively the closing direction X of the door. To preclude the drive element 70 from dropping out of the muff 80, a blocking pane 75 is configured on the rear end of the neck portion 73. The terminal part of the neck portion 73 somewhat projects from the muff 80 and is fitted a corresponding engaging groove (not shown).

To assure that the closing bar 40 always shall slide reliably into the engaging aperture 113 when the door is being closed, the collar 78 is fitted with an intake bevel 711 or similar. Preferably too, the bar 40 is fitted at its end with a conical surface or is rounded.

The lock assembly 10 of the present invention is installed as follows:

First the recess 25 is fitted into the side surface 27 of the planar component 20. Then the stepped borehole 22 is fashioned from the end face 28 and preferably runs perpendicularly both to said face and to the recess 25. Additional boreholes or recesses are not needed and commensurate economies are attained. Preferably both boreholes 22, 25 were already prefabricated.

The latching system 50 premounted in its housing 51 is laterally inserted into the recess 25 until the octagonal nut 23 is configured concentrically with the stepped borehole 22. Then the two trims 21 are placed into their recesses 25. Next the clamping mechanism 110—which is also pre-assembled—is inserted from the door's end face 28 into the stepped borehole 22 and is screwed by its rear end 803 into the octagonal nut 23. The installation tool illustratively may be a coin. The front flange end 802 of the muff 80 in this process comes against a stop in the stepped borehole 22, the height of the flange 802 and the geometry of the stepped borehole 22 being matched to each other in a way that the muff 80 shall lie flush with the door's end face 28. Lastly the axial screw 111 is screwed through the stepped borehole 71 into the coupling element 124.

By screwing the clamping mechanism 110 into the octagonal nut 23, the housing 51 together with its peripherally enclosing trims 21 shall be affixed in the recess 25. No further fasteners are needed, and both the manufacturing and installation costs are significantly reduced. Finally the operating elements 90 are laterally inserted into the recesses 25. In supplementary or alternative manner, the trims might be affixed in compressive and/or mechanically interlocking manner in the recess 25, for instance by omitted detent or clamping elements. In each case the handling and installation of the lock assembly 10 is exceedingly simple and renders superfluous on-site craftsman fitting.

Finally it remains to affix by screwing the closing bar 40 together with its bracket 100 to the frame 30, where possible at a height allowing said bar to engage, without being deflected, the clamping mechanism 100 respectively its drive element 70. Both the latching system 50 and the closing bar 40 might already be pre-mounted in readiness for the end customer at the door respectively the frame 30.

FIG. 3*a* shows the clamping mechanism 110 in its blocked position. This position is attained for instance by rotating by 90° the bathroom knob 91 in the closing direction S. In the process the spindle bush 122 supported in the housing 51 displaces the gear rack 123 upward (see FIGS. 2*a*, 2*b*), whereby said rack, due to its bent respectively control cam, releases the hook 1241 of the coupling element 124. Thereupon the compressed spring 112 is able to push forward the drive element 70 in the direction S, respectively the closing direction X until the blocking pane 75 comes to rest against the muff 80 as shown in FIG. 3*a*. Advantageously the collar 78 should be terminally approximately flush with the flange 802 of the muff 80. In this position the balls 61 of the clamping system 114 are forced inward from the conical surface 816 through the radial boreholes 74 in the drive element 70, as a result of which the balls 61 protrude into the engaging aperture 113.

To lock the door, respectively to operate the latching system 50, instead of using the bathroom knob 91, the key 92 may be used, which is inserted into a keyhole (not referenced) in the trim 21 respectively into the housing 51 and which displaces by means of an omitted mechanism the gear rack 123 and/or the coupling element 124.

When the door is closed in the direction X, the closing bar 40 dips into the engaging aperture 113 of the drive element 70 until coming to rest by its free end 42 against the balls 61 guided in the radial boreholes 74 and, upon further closing the door, forcing said balls in the direction R and radially outward. In the process, the drive element 70 is pushed against the force of the compression spring 112 somewhat farther in the direction R respectively in the direction of opening O until the conical surface 816 allows the balls 61 to move radially out of the way. Thereupon the bar 40 slides completely into the engaging aperture 113, the balls 61 coming to rest against said bar's side faces 41.

In this configuration already the door shall be locked. Nor cannot it be reopened short of actuating the operating element 90. If the attempt is made to move the sliding door wing 20 in the direction R respectively in the direction of opening O, the bar 40 attempts to move the balls and hence the drive element in the direction S. In this process however the balls 61 are forced radially outward against the oblique respectively conical surface 816 of the muff 80 which in turn firmly presses the balls 61 against the side faces 41 of the bar 40. The resultant frictional inter-locking is large enough to preclude door reopening. Instead the door is locked in virtually play-less manner.

The door shall be completely closed once the end face 28 of the door wing 20 rests against the recess E of the frame 30.

The present invention offers a further significant advantage in that the door even in its locked state can be closed any time because the closing bar 40 is able to dip in the direction R in the absence of substantial resistance and nearly noiselessly into the clamping mechanism 110. In the opposite direction S however, said bar shall be blocked by the clamping system 114 and therefore cannot be extracted from the drive element 70. Accordingly the door may be closed in virtually noiseless manner both in its locked and unlocked states because such closing takes place in the absence of moving otherwise noisy pivotable bolts or latches that a clicking motion would otherwise cause.

Because the radially floatingly supported closing bar 40 is always able to follow the instantaneous position of the clamping mechanism 110 and therefore always can reliably dip into the drive element 70, the door may be closed even when the door wing 20 and the frame 30 were no longer precisely positioned relative to each other, for instance due to thermal effects or wear.

The door is unlocked by rotating one of the operating elements 90 in the direction of opening O. In the process the lock's spindle bush 122 or the key 91 displace the bent gear rack 123 downward, whereby the coupling element 124 is moved rearward by the hook 1241 rearward in the direction R. The drive element 70 being affixed by the screw 111 to the coupling element 124, it is pulled against the opposing force of the compression spring 112 in the direction R (FIG. 3*b*). In that position the detent balls 61 now can move radially outward underneath the oblique surface 816 of the muff 80 and thus they release the closing bar 40. Said bar is able then to silently move out of the engaging aperture 113. The door can freely displaced in the direction of opening O.

In the embodiment mode of FIGS. 4*a* through 4*d*, the clamping system 114' of the clamping mechanism 110 is devoid of radially guided balls 61. The blocking and/or clamping element 61' instead is a clamping pane 62 able to axially affix the closing bar 40 in the door's closed position, as a result of which the door may be locked as needed. The clamping pane 62 rests on an outer muff 80' receiving a drive element 70' which is supported in axially displaceable manner.

The muff 80' is in two parts, namely a main part 85 and a terminal part 83 which may be screwed to the main part. To receive the drive element 70', the main part 85 is fitted with a central stepped borehole 81' comprising a total of three segments 819, 813', 814'. The inside diameter of the first segment 819 is the largest. This segment 819 is constituted in a flange end 802' of the main part 85 and terminates at a step 817'. The flange end 802' is fitted with an outer thread 804 and an offset 801. The front terminal part 83 of the muff 80' may be screwed onto the outer thread 804.

The inside diameter of the second segment 813' of the borehole 81' in the main part 85 is less than that of first segment 819 and terminates with a conical bevel 8131 merging into the third segment 814' of the borehole 81'. Said third segment is fitted terminally with an outer thread 82 to affix the clamping mechanism 110 in the octagonal nut 23 of the housing 51.

A stepped borehole 81" having two segments 811', 8110 is fitted into the front terminal part 83. The first segment 8110 is configured in the front zone of the terminal part 83. Its inside diameter is just large enough to allow the closing bar 40 to dip without significant play into the segment 8110 which constitutes the first part of the engaging aperture 113. Said first segment is fitted at its end with an intake bevel 711' for the bar 40.

The inside diameter of the second segment 811' is substantially larger than that of the first segment 8110. Said second segment is bounded in the S direction by the bevel 816'. Moreover the unreferenced inside thread allowing screwing the terminal part 83 on the main part 85 is configured in the borehole segment 811'. If the end part 83 is mounted on the main part 85, then the second segment 811' shall be bounded by the edge 818 of the flange end 802'. A clamping pane 62 is mounted in the segment 811'.

The drive element 70' is fitted with a cylindrical engaging part 72' inserted with little play of displacement into the middle segment 813' of the borehole 81' in the main part 85. The front end is fitted with two hooks 76 engaging the clamping pane 62 from behind. The rear end of the engaging part 72 adjoins a collar portion 73' receiving the screw 111.

As shown in more detail in FIG. 4*b*, the hooks 76 keep the clamping pane 62 in place at the drive element 70'. For that purpose the clamping pane 62 is fitted with a central hole 63 of which the diameter slightly exceeds the outside diameter of the closing bar 40. The hole 63 comprises two lateral indentations 64 to receive the neck portions 77 of the bayonet hooks 76. The depth of indentations 64 and the length of the neck portions 77 are selected in such a way that the clamping pane 62 on the neck portions 77 of the hooks can be tilted in the directions R and S.

As in the above shown embodiment modes, a spring 112' is configured between the muff 80' and the drive element 70'. In this instance however said spring encloses the engaging part 72' of the drive element and rests on one hand against the step 817' and on the other hand against the clamping pane 62. In this manner the clamping pane 62 is permanently pressed against the oblique surface 816' and is tilted relative to the longitudinal axis of the clamping mechanism 110.

The clamping mechanism 110 of this embodiment operates as follows:

FIG. 4*a* shows the clamping mechanism 110 in the blocked position. Such a position shall be reached by rotating by 90° the bathroom knob 91 in the closing direction S. In the process the spring 112' presses the clamping pane 62 against the oblique surface 816', thereby tilting the clamping pane 62. When seen from the direction R respectively S, the inside diameter of the hole 63 of the clamping pane 62 is constricted, as a result of which the clamping pane 62 initially constitutes an impediment when the engaging element 40 is inserted into the latching system 50.

When the door is closed in the X direction, the closing bar 40 dips into the engaging aperture 113 of the drive element 70' until impacting by its free end 42 the clamping pane 62 and—upon further door closing—pressing it against the opposing spring 112' in the R direction. In the process the clamping pane 62 positions itself approximately perpendicularly to the longitudinal axis of the bar 40 and in this manner opens the full diameter of the hole 63 to the engaging element 40. Said element 40 then may pass through the clamping pane 62 into the engaging part 72' of the drive element 70' in the direction R in continuous and free manner.

An ensuing displacement of the operating element 40 in the direction S is initially blocked. Such blocking arises from the friction between the clamping pane 62 and the side surface 41 of the engaging element 40. Namely, when the engaging element 40 has acted on the engaging part 72', the spring 112' will press the clamping plane 62 back in the direction S. In the process the clamping pane 62 is tilted again at the oblique surface 816' until the diameter seen from the direction R respectively S of the diameter of the hole 63 rests in frictional manner against the side surface 41 of the engaging element 40. A displacement of the engaging element 40 in the direction S would then entail further tilting of the clamping pane 62, this condition however being precluded because the pane 62 is more slanting. In this manner the motion of the engaging element 40 in the direction S is blocked.

To undo the blocking, the drive element 70' is pulled in the direction R by moving the operating element 90. In the process the bayonet hooks 76 pull back the clamping pane 62 against the force of the spring 112'. The tilting of the clamping pane 62 is eliminated either by said pane merely falling back or by its coming to rest against the edge 818. Consequently the diameter of the hole 63 as seen from the direction R respectively S is increased and the engaging element 40 is released.

In summary, the clamping mechanism 110 of all shown embodiment modes is designed in a manner that the engaging element 40 can act on the latching system 50, independently of the blocked state of the latching system 50, in the direction R while being blocked by the clamping mechanism 110 in the opposite direction S. It is important in this respect that the clamping mechanism 110 is coupled by the coupling mechanism 120 to the operating elements 90, as a result of which blocking may be undone again. On the other hand, closing the planar component 20 at the frame 30 does not require actuating the operating element 90, regardless of the locking state of the latching system 50.

The present invention is not restricted to the above described embodiment modes but may be modified in many ways. Many configurations of the engaging element 40 and the latching system 50 may be thought of. For instance the engaging element 40 also may be mounted on the planar component 20 and the latching system 50 in the frame 30. Again the engaging element 40 may be configured at an angle to the frame 30 or to the planar component 20 so that latter, for instance in the form of a rotary wing, can be affixed in position.

Different approaches and combinations also are feasible regarding the design of the operating element 90. It may be advantageous for instance to combine a handle or a bath knob 91 with a key 92, or to mount a knob on the first side of a planar component 20 and a handle on the other. Simple solutions also may suffice wherein only one bathroom knob 91 is used, or only one key.

Moreover various design variations of the clamping mechanism 110 are applicable. For instance several clamping panes 62 may be arrayed consecutively. Instead of balls 61 guided in the drive element 70, rollers also may be used as blocking and/or clamping elements 60. Designs wherein wedges or the like act as the blocking and/or clamping elements 60 are applicable.

Another feasibility is to constitute the stepped borehole 81, 81 containing the drive element 70, 70' not in the muff 80, 80' but directly in the planar component 20.

Again, the muff 80, 80' may be affixed not by means of a thread 82 in the planar component 20, but by being bond to it during installation, or by means of a detent mechanism.

However it must be borne in mind that the planar component 20 is moved toward the frame 30 in order to close a door or a window, for instance a sliding door. It is of significance whether the latching system at that time is in its blocked or in its released position. The engaging element 40 mounted on the frame 30 in either case will move freely in the direction R into the clamping mechanism 110. In the process the drive element 70, 70' is pressed in the direction R and the clamping mechanism 110 respectively the clamping mechanism 114, 114' shall be released. In this manner the engaging element 40 may engage unhampered the engaging aperture 113 of the engaging part 72, 72'. If the attempt is made thereupon to move the planar component 20 away from the frame, then the clamping system 114, 114' of the clamping mechanism 110 is activated and blocks the displacement of the engaging part 40 in the direction S. Only after the drive element 70, 70' has been pulled back by means of the operating element 90 and of the coupling mechanism 120 in the direction R or is kept in position regarding the direction R, will the clamping mechanism 110 release the engaging element 40 and allow reopening the door or the window.

All features and advantages explicitly stated by or implicit in the claims, specification and drawings, inclusive design details, spatial configurations and procedural steps, may be construed being inventive per se or in arbitrary combinations.

LIST OF REFERENCES

| | |
|---|---|
| E | recess |
| K | longitudinal edge |
| O | planar component's direction of opening |
| R | direction 1 |
| S | direction 2 |
| X | closing direction of planar component |
| Y | direction 3 |
| Z | direction 4 |
| 10 | lock assembly |
| 20 | planar component |
| 21 | trim |
| 22 | borehole |
| 23 | octagonal nut |
| 231 | beak |
| 24 | inside thread |
| 25 | recess |
| 26 | notch |
| 27 | side surface |
| 28 | end face/terminal side |
| 30 | frame |
| 32 | edge shoulder |
| 40 | engaging element |
| 41 | side surface |
| 42 | conical surface |
| 50 | latching system |
| 51 | housing |
| 60 | blocking and/or clamping element |
| 61 | ball |
| 62 | clamping pane |
| 63 | hole |
| 64 | indentation |
| 70, 70' | drive element |
| 702, 701' | front part |
| 702, 702' | rear part |
| 71, 71' | stepped borehole |
| 711, 711' | intake bevel |
| 72, 72' | engaging part |
| 73, 73' | neck portion |
| 74 | radial borehole/feedthrough |

-continued

| LIST OF REFERENCES | |
|---|---|
| 75 | blocking pane |
| 76 | hook |
| 77 | neck portion |
| 78 | collar |
| 80, 80' | muff |
| 801 | offset |
| 802, 802' | flange end |
| 803 | rear end |
| 804 | thread |
| 81, 81', 81" | stepped borehole |
| 811, 811' | cylindrical borehole segment |
| 8110 | cylindrical borehole segment |
| 812 | conical borehole segment |
| 813, 813' | cylindrical borehole segment |
| 8131 | cone |
| 814, 814' | cylindrical borehole segment |
| 815, 815' | step |
| 816, 816' | oblique surface |
| 817 | step |
| 818 | edge |
| 819 | cylindrical borehole segment |
| 82 | thread |
| 83 | terminal part |
| 84 | notch |
| 85 | flange screw |
| 90 | operating element |
| 91 | bathroom knob |
| 92 | key |
| 100 | bracket |
| 110 | clamping mechanism |
| 111 | screw |
| 112, 112' | spring |
| 113 | engaging aperture |
| 114, 114' | clamping system |
| 120 | coupling mechanism |
| 121 | square/tetragonal opening |
| 122 | spindle hub |
| 123 | lever/gear rack |
| 124 | coupling element |
| 1241 | hook |
| 1242 | threaded borehole |

The invention claimed is:

1. A lock assembly for a planar component, with the planar component being displaceably configured in relation to a frame and configured to move in a direction toward the frame toward a closed position and a direction away from the frame to an open position, the lock assembly comprising;

an engaging element configured to be located in a recess defined in the frame, in the closed position of the planar element, the engaging element configured to be affixed in a latching system, the latching system configured to be disposed in a borehole defined in the planar component, the latching system including a clamping mechanism, the latching system being configured to be contained within the planar component during operation of the lock assembly, wherein the engaging element is affixable by one of compression and friction in the latching system, the latching system being designed in a manner such that in a blocked position of the clamping mechanism, the engaging element can be inserted into an aperture defined in the latching system in a first direction opposite the direction of closing of the planar component, whereas after insertion a withdrawal of the engaging element is prevented from movement in a second direction opposite the direction of opening of the planar component by one of a blocking and clamping elements of the clamping mechanism that by inserting the engaging element into the latching system in the first direction, the blocking and clamping elements release and open the aperture, so that the engaging element is free to move in the first direction even if the lock assembly is in a locked position, wherein one of the blocking and clamping elements are one of balls, roller, and wedges, and wherein the engaging element is supported by a bracket disposed in the door frame, with the bracket configured to allow the engaging element to move in a direction vertically relative to the door frame and move in a direction perpendicularly relative to such vertical movement direction in a floating manner wherein the engaging element adjusts itself, without tools, to engage the clamping mechanism of the latching system.

2. A lock assembly as claimed in claim 1, wherein the engaging element can be inserted unhampered in the first direction into the latching system independently of the blocked position of the latching system.

3. A lock assembly as claimed in claim 1, wherein the one of the blocking and clamping elements cooperate with at least one side surface of the engaging element.

4. A lock assembly as claimed in claim 1, wherein one of the blocking and clamping elements can engage the side surface of the engaging element.

5. A lock assembly as claimed in claim 1, wherein one of the blocking and clamping elements are one of axially and radially driven by the engaging element displaced in the first direction.

6. A lock assembly as claimed in claim 1, wherein one of the blocking and clamping elements are guided in an axially displaceable drive element.

7. A lock assembly as claimed in claim 6, wherein a displacement of the drive element in the first direction undoes the affixation of the engaging element due to the one of the blocking and clamping elements.

8. A lock assembly as claimed in claim 6, wherein the drive element is permanently biased in the second direction.

9. A lock assembly as claimed in claim 8, wherein a spring force biases the drive element.

10. A lock assembly as claimed in claim 1, including a fastener defining an axial bore and further defining a thread on one end, the fastener configured to receive the drive element and couples the latching system to the planer component.

11. A lock assembly as claimed in claim 1, wherein the latching system includes at least one oblique surface defined in the fastener.

12. A lock assembly as claimed in claim 11, wherein the one of the blocking and clamping elements are disposed between the oblique surface and the drive element.

13. A lock assembly as claimed in claim 1, wherein the drive element is fitted with radial feedthroughs receiving the one of blocking and clamping elements.

14. A lock assembly as claimed in claim 1, characterized in that the blocking and/or clamping element is a clamping frame or a clamping pane enclosing the engaging element.

15. A lock assembly as claimed in claim 14, characterized in that the blocking and/or clamping element is pivotably supported.

16. A lock assembly as claimed in claim 14, characterized in that the blocking and/or clamping element is oblique to the first direction.

17. A lock assembly as claimed in claim 14, characterized in that at least two clamping frames or clamping panes are used.

18. A lock assembly as claimed in claim 17, characterized in that the clamping frames or clamping panes are sequentially configured in the first direction.

19. A lock assembly as claimed in claim 1, further comprising an operating element operatively coupled to the latching system and is configured to drive the latching system into one of a locked and unlocked condition.

20. A lock assembly as claimed in claim 19, wherein the operating element is coupled to the drive element.

21. A lock assembly as claimed in claim 19, wherein the drive element is axially displaceable by the operating element.

22. A lock assembly as claimed in claim 19, wherein the drive element is configured to be mechanically stopped by the operating element in its blocking position and by the latching system in its release position.

23. A lock assembly as claimed in claim 1, wherein the latching system includes a trim member configured to fully cover a recess defined in the planar components, with the recess configured to receive the latching system and associated operating element.

* * * * *

UNITED STATES PATENT AND TRADEMARK OFFICE

CERTIFICATE OF CORRECTION

PATENT NO. : 8,905,443 B2
APPLICATION NO. : 12/382832
DATED : December 9, 2014
INVENTOR(S) : Helmut Alber It is certified that error appears in the above-identified patent and that said Letters Patent is hereby corrected as shown below:

On the title page item (75) Inventor:

"Helmut Alber, Schianders (IT)" should read --Helmut Alber, Schlanders (IT)--.

Signed and Sealed this
Sixth Day of October, 2015

Michelle K. Lee

Michelle K. Lee
*Director of the United States Patent and Trademark Office*